United States Patent [19]

D'Heureuse et al.

[11] Patent Number: 4,962,705

[45] Date of Patent: Oct. 16, 1990

[54] DAMPENER FOR AN OFFSET PRINTING MACHINE

[75] Inventors: Walter D'Heureuse, Ladenburg; Hans-Jürgen Kusch, Neckargemünd; Gerhard Heppenstiel, Bammental; Rudi Stellberger, Kronau, all of Fed. Rep. of Germany

[73] Assignee: Heidelberger Druckmaschinen AG, Heidelberg, Fed. Rep. of Germany

[21] Appl. No.: 211,978

[22] Filed: Jun. 27, 1988

[30] Foreign Application Priority Data

Jun. 25, 1987 [DE] Fed. Rep. of Germany ..... 3720986
Apr. 23, 1988 [DE] Fed. Rep. of Germany ..... 3813829

[51] Int. Cl.[5] ..... B41L 23/02; B41L 25/02

[52] U.S. Cl. ..... 101/148; 101/350

[58] Field of Search ..... 101/147, 148, 1, 350, 101/351, 354, 363, 207, 208, 210, 315, 321, 364, 367; 118/258, 259, 261, 262, 407

[56] References Cited

U.S. PATENT DOCUMENTS

| | | | |
|---|---|---|---|
| 3,902,417 | 9/1975 | Fischer | 101/148 |
| 4,127,067 | 11/1978 | Dahlgren et al. | 101/148 X |
| 4,453,463 | 6/1984 | Dahlgren et al. | 101/350 X |
| 4,455,938 | 6/1984 | Loudon | 101/148 |
| 4,724,764 | 2/1988 | MacPhee et al. | 101/148 X |

FOREIGN PATENT DOCUMENTS

| | | |
|---|---|---|
| 2206498 | 9/1972 | Fed. Rep. of Germany . |
| 1761245 | 12/1972 | Fed. Rep. of Germany . |
| 2845932 | 4/1980 | Fed. Rep. of Germany . |

*Primary Examiner*—Edgar S. Burr
*Assistant Examiner*—Moshe I. Cohen
*Attorney, Agent, or Firm*—Herbert L. Lerner; Laurence A. Greenberg

[57] ABSTRACT

A dampening unit for an offset printing machine, includes a roller pair consisting of a metering roller, and a dampening form roller for applying dampening medium to a plate cylinder of the printing machine, the metering roller and the form roller being in mutually pressing engagement at a first contact zone along respective axially parallel lines on respective casings of the roller pair, a gear drive for driving the roller pair with circumferential speeds of the metering roller and the form roller substantially in a downward direction in vicinity of the contact zone, and means defining a storage space for dampening medium located above the contact zone and including surfaces of the casings of the roller pair and sealing elements located at respective ends of the roller pair, only the metering roller of the roller pair being driven by a gear meshing with a drive gear of the gear drive, the form roller being in driven engagement via friction contact at the first contact zone in a first position of the form roller wherein the form roller is lifted away from the plate cylinder, and being in driven engagement via friction contact both at the first contact zone and at a second contact zone between the form roller and the plate cylinder in a second position of the form roller wherein the form roller is in engagement with the plate cylinder, the metering roller being drivable at a circumferential speed increased to such an extent over that of the plate cylinder to compensate for braking moments applied to the form roller so that the form roller rotates in the second position thereof with a circumferential speed slower by an order of magnitude of 0.5% to 2% than the circumferential speed of the plate cylinder.

1 Claim, 2 Drawing Sheets

DAMPENER FOR AN OFFSET PRINTING MACHINE

Figure 1:
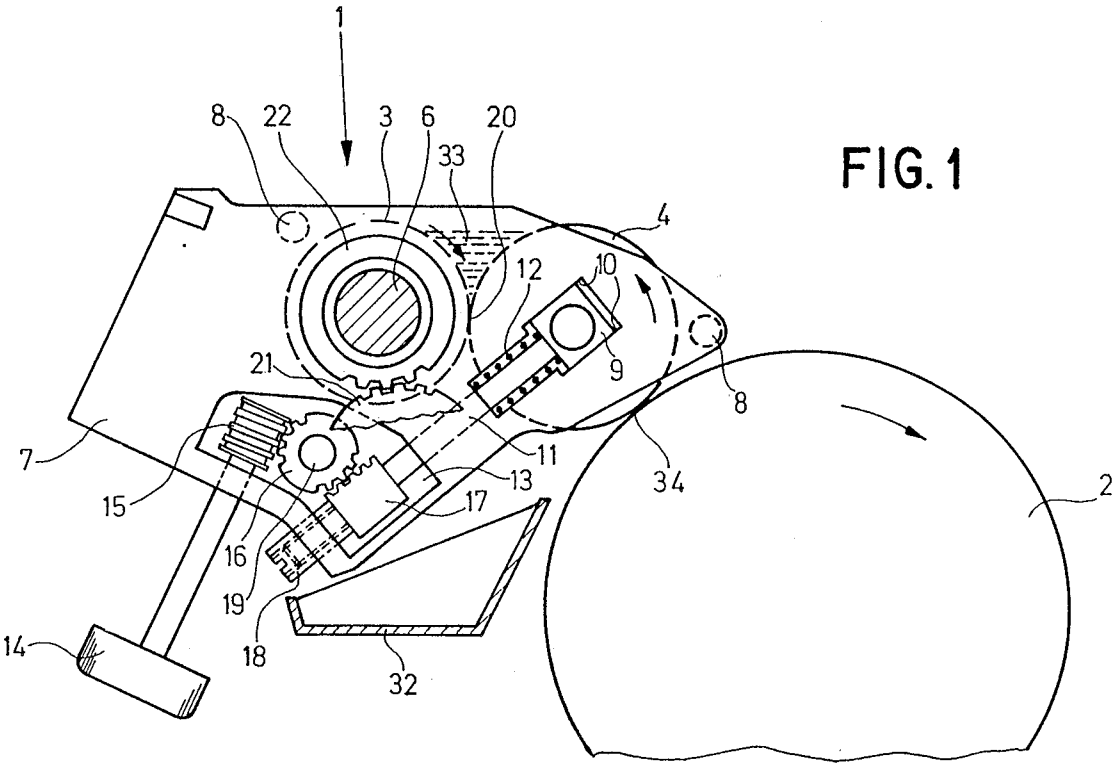

The invention relates to a dampener for an offset printing machine which includes a pair of rollers consisting of a metering roller, and a dampening form roller for applying dampening medium to a plate cylinder of the printing machine, the metering roller and the form roller being in mutually pressing engagement at a contact zone along respective axially parallel lines on respective casings of the rollers, drive means such as a gear drive for rotating the metering roller and the form roller with circumferential speeds which are substantially in a downward direction in vicinity of the contact zone, and means defining a storage space for dampening medium located above the contact zone and including surfaces of the casings of the metering roller and the form roller and sealing elements located at respective ends of the metering roller and the form roller.

Such a dampener has become known heretofore from German Published Non-prosecuted Application (DE-OS) No. 22 06 498 wherein a dampening form roller is driven, via a gear which is connected thereto, by means of a gear connected to a plate cylinder and meshing with the gear connected to the form roller. This type of drive involves a potential danger of the formation of so-called "gear streaks" on the material being printed which may be produced by play between the edges of the gear teeth.

More recently, in the case of similar dampener systems, the gear drive, although disadvantageous in printing technology, has nevertheless been maintained for the dampening form roller (note U.S. Pat. No. 4,455,938).

It is accordingly an object of the invention to provide a dampener of the foregoing general type with which a clean printed image is attainable which is especially free from any "gear streaks".

With the foregoing and other objects in view, there is provided, in accordance with the invention, a dampening unit for an offset printing machine, comprising a roller pair consisting of a metering roller, and a dampening form roller for applying dampening medium to a plate cylinder of the printing machine, the metering roller and the form roller being in mutually pressing engagement at a first contact zone along respective axially parallel lines on respective casings of the roller pair, a gear drive for driving the roller pair with circumferential speeds of the metering roller and the form roller substantially in a downward direction in vicinity of the contact zone, and means defining a storage space for dampening medium located above the contact zone and including surfaces of the casings of the roller pair and sealing elements located at respective ends of the roller pair, only the metering roller of the roller pair being driven by a gear meshing with a drive gear of the gear drive, the form roller being in driven engagement via friction contact at the first contact zone in a first position of the form roller wherein the form roller is lifted away from the plate cylinder, and being in driven engagement via friction contact both at the first contact zone and at a second contact zone between the form roller and the plane cylinder in a second position of the form roller wherein the form roller is in engagement with the plate cylinder, the metering roller being drivable at a circumferential speed increased to such an extent over that of the plate cylinder to compensate for braking moments applied to the form roller so that the form roller rotates in the second position thereof with a circumferential speed slower by an order of magnitude of 0.5 to 2% than the circumferential speed of the plate cylinder.

In the embodiment constructed in accordance with the invention, the dampening form roller is driven exclusively by friction. Consequently, the generally elastic covering of the form roller soothes or relieves any vibrations which may possibly derive from the gear drive of the metering roller, so that the appearance of so-called "gear streaks", which are undesirable in printing technology, are counteracted or inhibited.

As a result of the slower circumferential speed of tne form roller, which is of an order of magnitude of 0.5 to 2% less than that of the plate cylinder, a wiping action takes place which prevents the deposition or accumulation upon the printing plate of the plate cylinder of solids from the printing ink or from the material to be printed on, so that a printed image is obtained which is free of impurities.

The operation of the dampener according to the invention with the given slip between the plate cylinder and the form roller produces, as a further advantage, also an exceptionally stable or rugged dampening-medium film on the printing plate which does not tear off easily.

Another advantage is provided by the slippage between the form roller and the plate cylinder in that it counteracts or inhibits the development of water streaks.

Yet an additional advantage of the aforementioned slip or slippage is that it counteracts or inhibits oxidation of the printing plate.

Other features which are considered as characteristic for the invention are set forth in the appended claims.

Although the invention is illustrated and described herein as embodied in dampener for an offset printing machine, it is nevertheless not intended to be limited to the details shown, since various modifications and structural changes may be made therein without departing from the spirit of the invention and within the scope and range of equivalents of the claims.

Figure 2:
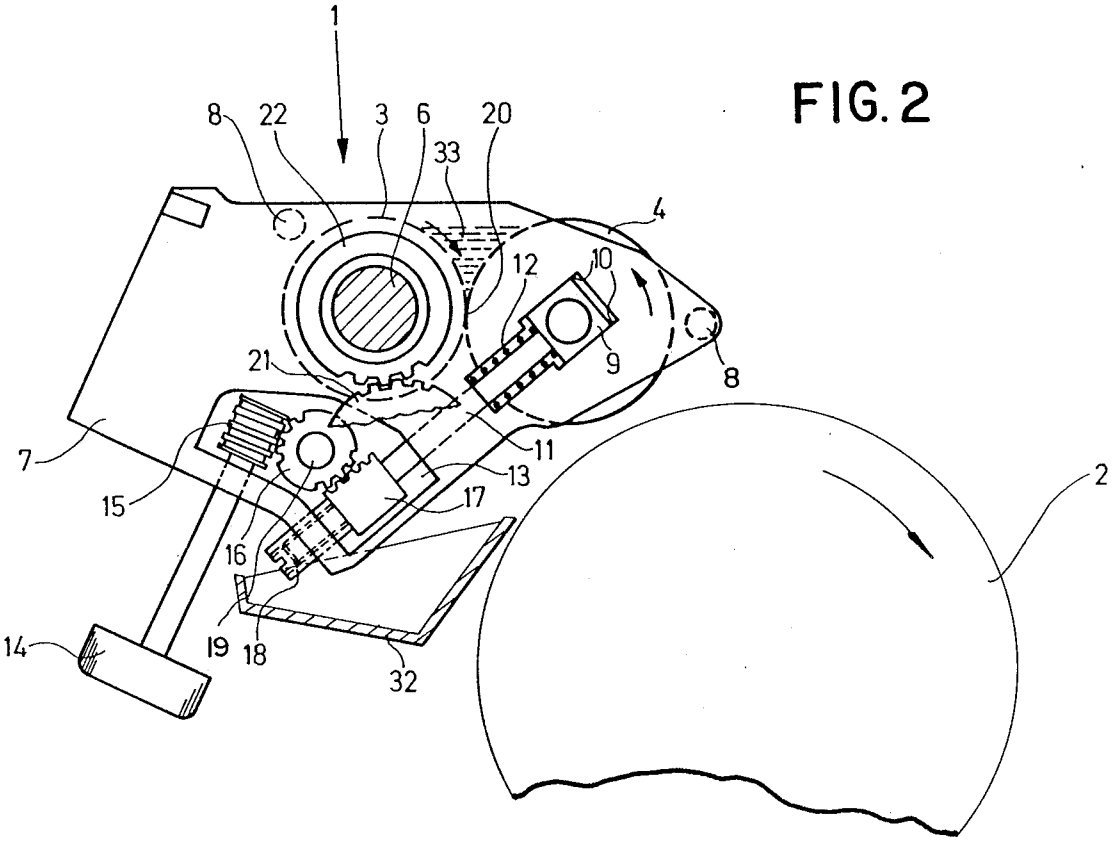

The construction and method of operation of the invention, however, together with additional objects and advantages thereof will be best understood from the following description of specific embodiments when read in connection with the accompanying figures of a drawing:

FIG. 1 is a diagrammatic side elevational view, partly in section, of an embodiment of the dampener according to the invention in one operating phase thereof; and FIG. 2 is a view like that of FIG. 1 of the embodiment in another operating phase thereof.

Referring now to the figures of the drawing, there is shown therein a dampener or dampening unit 1 engaged with a plate cylinder 2. The dampener 1 encompasses a metering roller 3 which is in contact with an applicator or form roller 4 for the dampening medium. A shaft 6 carrying the metering roller 3 is accommodated at both ends thereof in respective non-illustrated stationary bearings of the machine A respective bearing plate 7 is disposed at the end faces of the metering roller 3 on a respective shaft pin of the shaft 6 so as to be pivotable about the latter. Both of the bearing plates 7 are mutually connected by traverses 8. The applicator or form roller 4 is mounted by the ends thereof in respective guide shoes 9, only one of which is shown in the figure, the guide shoes 9, in turn, sliding on rectilinear guiding surfaces 10 which are machined into the bearing plates 7. These guiding surfaces 10 extend substantially parallel to the direction of a tangent to the plate cylinder 2 at its contact point with the form roller 4. The guide shoes 9, respectively, are connected to a respective free end of a shaft 11 formed with a thread and extending in the direction of the guiding surfaces 10 and guided by the respective bearing plate 7

A respective compression spring 12 braced against the bearing plate 7 biases the respective guide shoe 9 in the direction of "Releasing the contact thereof with the metering roller". The shaft 11, furthermore, passes through a recess 13 formed in the respective bearing plate 7, wherein a respective adjusting drive for the respective guide shoe 9 is provided The respective adjusting drive is formed of a toothed rack 17 arranged slidably on the shaft 11 and abutting an adjustable sleeve 18 screwed onto the thread of the shaft 11, and a non-illustrated gear meshing with the toothed rack 17 and disposed coaxially with a worm gear 16. The non-illustrated gears for adjusting the respective toothed rack 17 of each of the adjusting drives, respectively, are both fastened in common on one adjusting shaft 19. Furthermore, the worm gear 16 meshing with a worm 15 is also fastened to this adjusting shaft 19, so that the adjusting shaft 19 is turnable by one actuating member 14 arranged on the worm 15.

Dampening medium is located in a storage space 33 formed in an upper wedge or nip between the metering roller 3 and the form roller 4 and enclosed therein by suitable non-illustrated seals or sealing elements at the end faces of the rollers 3 and 4. A quantity of dampening medium adjustable by the mutual pressing-together of these rollers 3 and 4 with the aid of the actuating member 14 is fed or advanced to the plate cylinder 2 through a first contact zone 20 of these rollers 3 and 4 via the casing surface of the form roller 4 located below the contact zone 20. In this regard, the dampening unit is equipped with a gear drive for rotating the metering roller 3 and the form roller 4, with the circumferential speeds of this roller pair being in a downward direction in vicinity of the contact zone 20, as seen in the figure. This gear drive drives the metering roller 3 at a circumferential speed greater than that of the plate cylinder 2. This occurs via a driving gear 21 of the gear drive which meshes with a gear 22 arranged coaxially with the metering roller 3 and connected therewith by a non-illustrated free-wheeling gear or the like.

A trough 32 serves for catching dampening-medium residue from the storage space 33 if or when the metering roller 3 and the form roller 4 are separated from one another at the first contact zone 20 by the actuating member 14, if necessary or desirable for cleaning purposes.

The dampening form roller 4, in a second position thereof shown in FIG. 1 of the drawing, is driven by friction at the first contact zone 20 and at a second contact zone 34, whereas the dampening form roller 4 in a first position thereof shown in FIG. 2, in which the dampening form roller 4 is lifted away from the plate cylinder 2, is exclusively driven by friction at the first contact zone 20.

Thus, as aforementioned, the dampener 1 is shown in the drawing in the second position thereof wherein it is in engagement with the plate cylinder 2 To stop the dampener 1, the latter is swingable into the first position thereof by pivoting the bearing plates 7 about the shaft pins of the shaft 6 in counterclockwise direction, as viewed in the figure.

Form rollers of dampeners are generally formed with soft surfaces. Due to the squeezing action which is to be applied with the mutual pressing-together of the metering roller 3 and the form roller 4, a braking moment is exerted on the roller pair. In addition thereto are the braking moments resulting from bearing friction and, in the case of dampeners of the foregoing general type, additional braking moments deriving from the friction of the sealing elements at the respective ends of the roller pair 3, 4.

In the invention of the instant application, these friction moments or torques are deliberately exploited and are compensated for by the drive of the metering roller 3 with a rotary speed which is increased over that of the plate cylinder 2 to such an extent that the form roller 4 rotates, in the second position thereof, with a circumferential speed which is lower by an order of magnitude of 0.5 to 2% than the circumferential speed of the plate cylinder 2.

The size of the braking moment applied by the sealing elements to the form roller 4 can be influenced within given limits by the sealing force exerted by the sealing elements.

In the embodiment of the invention illustrated in the drawing, the increased or greater circumferential speed of the metering roller 3 is attained by providing the metering roller 3 with an outer diameter which is greater than that of the pitch circle of the gear 22 driving the metering roller 3.

There is claimed:

1. A dampening unit for an offset printing machine, comprising a roller pair consisting of a metering roller, and a dampening form roller for applying dampening medium to a plate cylinder of the printing machine, said metering roller and said form roller being in mutually pressing engagement at a first contact zone along respective axially parallel lines on respective outer cylindrical surfaces of said roller pair, a gear drive for driving said roller pair with circumferential speeds of said metering roller and said form roller substantially in a downward direction in vicinity of said contact zone, and means defining a storage space for dampening medium located above said contact zone and including said outer cylindrical surfaces of said roller pair, only said metering roller of said roller pair being driven by a gear meshing with a drive gear of said gear drive, said form roller being driven solely by engagement via friction contact with said metering roller at said first contact zone in a first position of said form roller wherein said form roller is lifted away from said plate cylinder, and being in driven engagement solely via friction contact both at said first contact zone and at a second contact zone between said form roller and said plate cylinder in a second position of said form roller wherein said form roller is in engagement with said plate cylinder, and means for driving said metering roller at a circumferential speed which is increased to such an extent over that of said plate cylinder sufficient to compensate for braking moments applied to said form roller so that said form roller when in said second position rotates with a circumferential speed slower by an order of magnitude of 0.5 to 2% than the circumferential speed of said plate cylinder with consequent slippage between said form roller and said plate cylinder.

* * * * *